United States Patent [19]

Oliff et al.

[11] Patent Number: 4,735,315

[45] Date of Patent: Apr. 5, 1988

[54] CAN CARTON

[75] Inventors: James R. Oliff, Austell; Rodney K. Calvert, Dunwoody, both of Ga.

[73] Assignee: The Mead Corporation, Dayton, Ohio

[21] Appl. No.: 96,597

[22] Filed: Sep. 14, 1987

[51] Int. Cl.[4] ..... B65D 85/62

[52] U.S. Cl. ..... 206/427; 206/428; 206/499

[58] Field of Search ..... 206/428, 427, 499; 229/52 B, DIG. 3

[56] References Cited

U.S. PATENT DOCUMENTS

| | | | |
|---|---|---|---|
| 2,359,297 | 10/1944 | Brouden | 206/428 |
| 2,874,869 | 2/1959 | Hennessey | 206/428 |
| 4,032,053 | 6/1977 | Wilson | 206/428 |
| 4,378,879 | 4/1983 | Killy | 206/427 |
| 4,482,090 | 11/1984 | Milliens | 206/427 |
| 4,523,676 | 6/1985 | Barrash | 206/428 |
| 4,546,914 | 10/1985 | Roccaforte | 206/427 |

*Primary Examiner*—Joseph Man-Fu Moy

*Attorney, Agent, or Firm*—Rodgers & Rodgers

[57] ABSTRACT

A carton for packaging a plurality of cylindrical articles includes top, bottom and side walls foldably joined to form an end loading tubular structure, as well as end closure flaps foldably joined to each end edge of the top and side walls together with a bottom end closure flap adjoined to each end edge of the bottom wall of the carton by an upwardly and outwardly inclined bevel strip disposed alongside inwardly and downwardly inclined beveled circular connecting structure forming the lower rim portion of the packaged items thereby to eliminate square corners at the ends of the bottom of the carton and a resulting tendency of the end walls of the carton to bow outwardly when stacked in tiers, one above the other.

8 Claims, 3 Drawing Sheets

CAN CARTON

TECHNICAL FIELD

This invention relates to packaging a plurality of cylindrical articles in an end loading tubular structure having closure flaps at its ends.

BACKGROUND ART

U.S. Pat. No. 4,558,816 issued Dec. 17, 1985 and owned by the assignee of this invention discloses a can carton of the general type to which this invention is applicable and unlike this invention is concerned with an improved carrying handle for cartons of the general type to which U.S. Pat. No. 4,558,816 is applicable.

BEST MODE OF CARRYING OUT THE INVENTION

Figure 1:
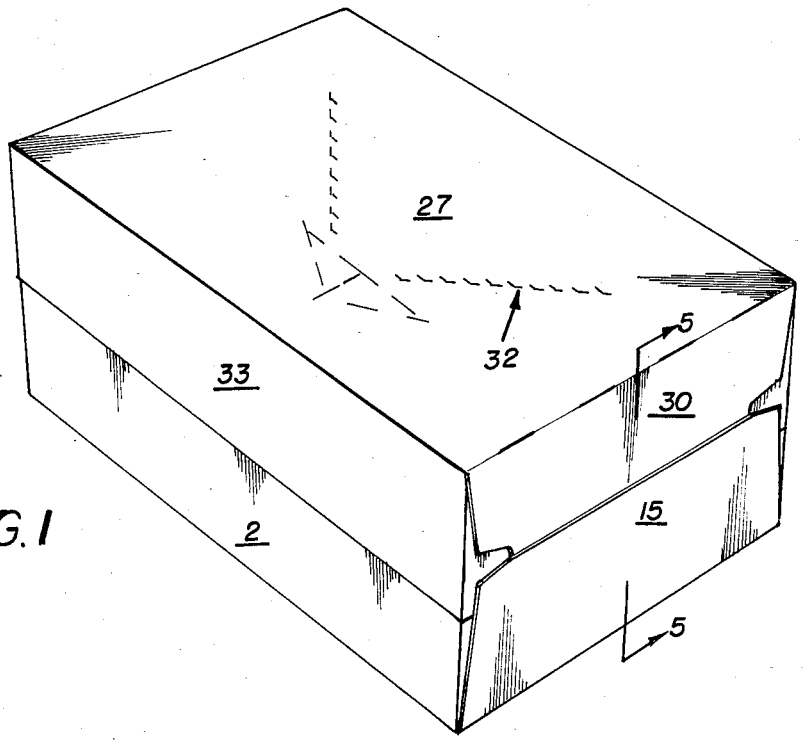
FIG. 1 is a perspective view of a fully loaded carton which embodies this invention.
Figure 3:
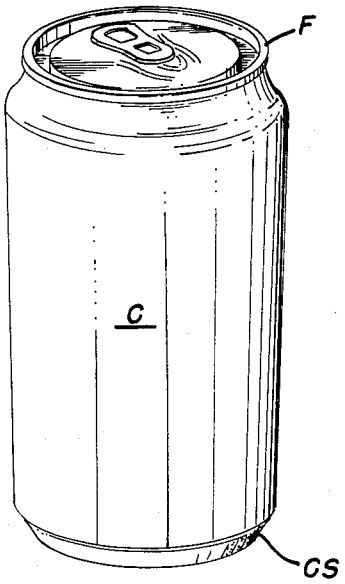
FIG. 3 is a perspective view of a cylindrical can of the type with which this invention is concerned.
Figure 4:
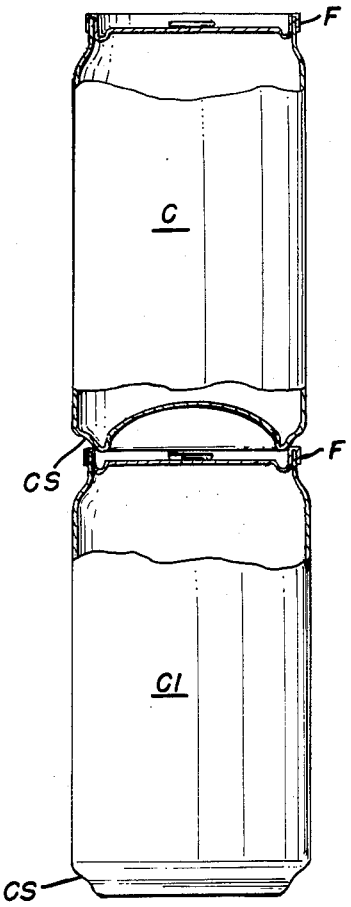
FIG. 4 is a view partially in cross section of a can such as is shown in FIG. 3 when stacked atop another similar can.
Figure 2:
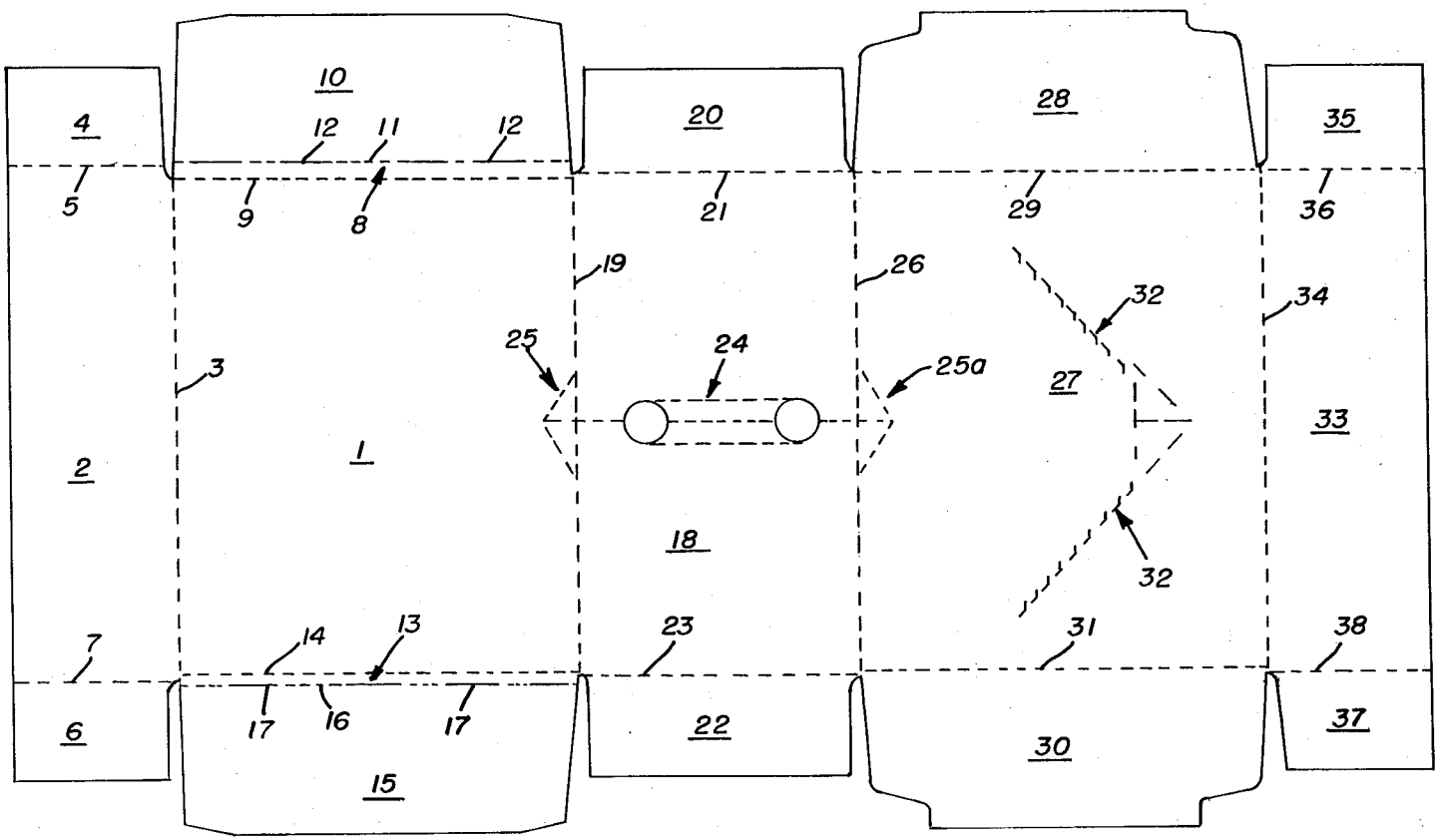
FIG. 2 is a plan view of a blank used in forming the carton of FIG. 1 as viewed from the inside.

With reference primarily to FIG. 2, the numeral 1 designates the bottom wall of the carton to one side edge of which a side wall forming panel 2 is foldably joined along a fold line 3. End closure flap 4 is foldably joined to one end of side wall forming panel 2 along a fold line 5 and an end closure flap 6 is foldably joined to side wall forming panel 2 along a fold line 7. A bevel strip 8 is foldably joined to an end edge of bottom wall 1 along a fold line 9 and an end closure flap 10 is foldably joined to bevel strip 8 along a fold line 11 which preferably includes slits 12 for rendering the folding resistance along fold line 11 somewhat less than resistance to fold offered by fold line 9. At the other end of the carton, a bevel strip 13 is foldably joined to an end edge of bottom wall 1 along a fold line 14 and an end closure flap 15 is foldably joined to bevel strip 13 along fold line 16 which preferably includes a plurality of slits 17 for rendering the fold line 16 less resistant to folding than the fold line 14.

Side wall 18 is foldably joined to bottom wall 1 along fold line 19. An end closure flap 20 is foldably joined to one end edge of side wall 18 along fold line 21 while end closure flap 22 is foldably joined to the opposite end of said wall 18 along fold line 23. Handle structure formed in side wall 18 is generally designated by the numeral 24 and includes perforated structure generally designated at 25 which is formed in bottom wall 1 and at 25*a* which is formed in top wall 27 which is foldably joined to side wall 18 along fold line 26. Handle structures 24, 25 and 25*a* is disclosed and covered by the above mentioned U.S. Pat. No. 4,558,816 and forms no part of the present invention.

End closure flap 28 is foldably joined to top wall 27 along fold line 29 and end closure flap 30 is foldably joined to the opposite end of top wall 27 along fold line 31. A plurality of slits such as are generally indicated at 32 constitute tear structure which facilitates opening of the carton to expose its contents. Side wall forming panel 33 is foldably joined to an edge of top wall 27 along a fold line 34 while end flap 34 is foldably joined to an end of side wall forming panel 33 along fold line 36. At the other end of the carton, end closure flap 37 is foldably joined to side wall forming panel 33 along fold line 38.

In order to complete a sleeve structure from the blank shown in FIG. 2, side wall forming panel 2 is folded upwardly and toward the right along fold line 3. Thereafter an application of glue is made to the outer surface of side wall forming panel 2 and to end closure flaps 4 and 6 along the edges thereof remote from fold line 3. Thereafter top wall 27 is elevated and folded toward the left along fold line 26 into flat face contacting relation with a portion of the inner surface of bottom wall 1 and with a portion of the side wall 18. This operation of course swings side wall forming panel 33 into partial overlapping relation with side wall forming panel 2 and results in adhesion of an edge of panel 33 with an edge of panel 2 in overlapping relation in a manner well known in the art.

Figure 9:
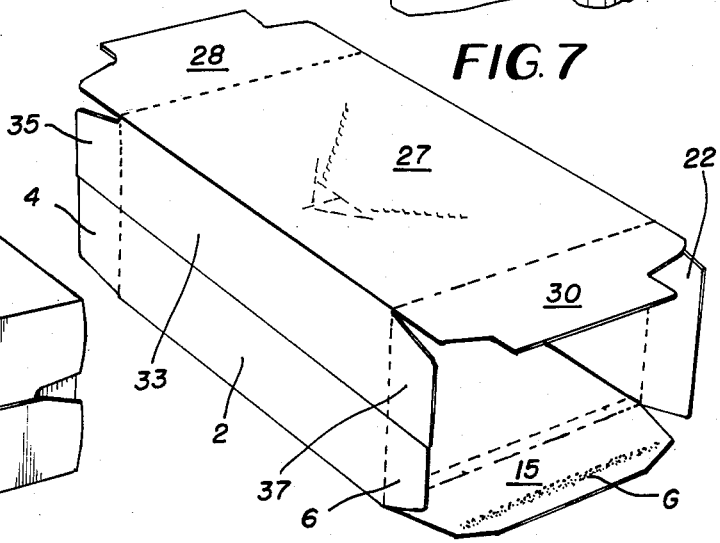
FIG. 9 is a perspective view showing a carton formed according to this invention with the end flaps open and which shows an application of glue to one flap which effects adhesion of all of the end flaps at the end of the carton.

In order to condition the carton for end loading through both its ends, the structure formed as described is manipulated generally into the condition represented in FIG. 9. Cylindrical articles may then be loaded through both ends of the carton so that the bottoms of the cans are disposed on bottom wall 1 and so that top wall 27 overlies the tops of the cans.

Figure 10:
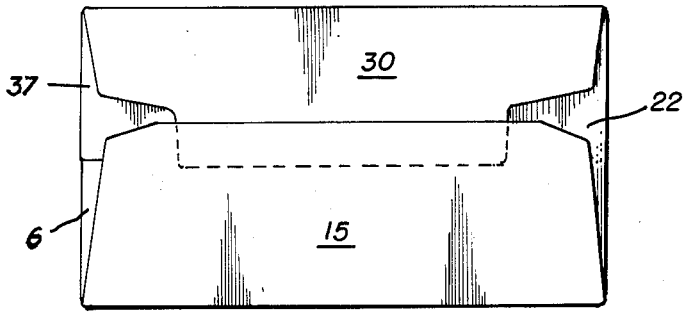
FIG. 10 is an end view of a carton such as is shown in FIG. 9 with the end flaps closed.

After loading of the can in the tubular structure, an application of glue as indicated at G is applied to the inner surface of end closure flap 15 as indicated in FIG. 9. Thereafter composite end closure flap 6, 37 and end closure flap 22 are folded inwardly along the composite fold line 7, 38 in the case of composite closure flap 6, 37 and along fold line 23 in the case of end closure flap 22. Thereafter end closure flap 30 is folded downwardly along fold line 31 followed by upward folding of bottom end closure flap 15 and the bevel strip 13 along fold lines 16 and 14. This folding operation causes the closure flaps 15 and 30 to be secured together and due to the cutaway corners formed in the outer parts of end closure flap 30, the glue G contacts the outer surfaces of end closure flap 22 and of composite end closure flap 6, 37 so that the entire end closing structure is secured together as a unit. Upon completion of the end closing operation as described in connection with FIG. 9, the carton appears from its closed end as shown in FIG. 10. Of course the opposite end of the carton is closed in a manner identical to the procedure just described.

Figure 6:
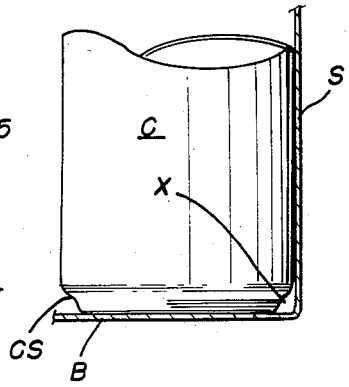
FIG. 6 is a fragmentary cross sectional view of a conventional can carton having squared corners at the bottom of each end.

Conventional corner structure for cartons of the type to which this invention is applicable are represented in FIG. 6. In FIG. 6 it is clear that the space indicated in X is formed between the bottom B and end wall S of the carton and the inwardly and downwardly tapered circular connecting structure CS by which the bottom of the can C is secured to the side wall of the can.

Figure 7:
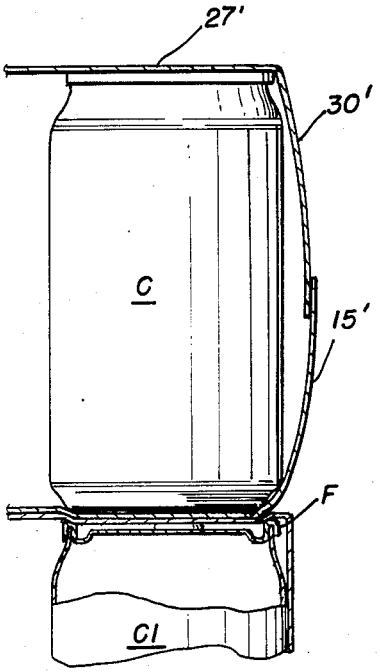
FIG. 7 is a view showing the effect of stacking one can of the type shown in FIG. 3 atop another similar can wherein both cans are packaged within can cartons and show the outward bowing tendency of the end walls of cartons stacked and formed with square corners as shown in FIG. 6.
Figure 8:
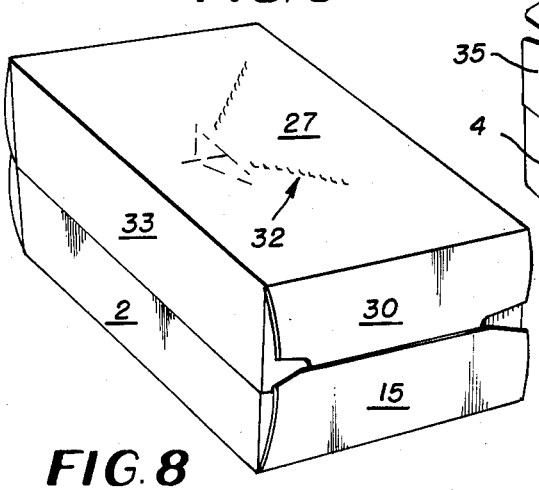
FIG. 8 is a perspective view somewhat similar to FIG. 1 but which shows the outward bowing of the end walls of the carton as shown in cross section in FIG. 7.

Since handling of packages of the type to which this invention is applicable normally is by means of palletized arrangements wherein cartons are stacked in tiers one above the other as indicated in FIG. 7 where the can C is disposed atop the can C1 in coincidental relation immediately above the lower tier. As shown in FIG. 7, the upper flange F of can C1 in the lower tier engages the square corner of the conventional carton as shown in FIG. 6 and results in outward bowing of panels such as 15' and 30'. Of course this outward bowing is highly undesirable and includes a cumulative effect so that the bowing becomes progressively greater in lower tiers of cartons as compared with the upper tiers.

Figure 5:
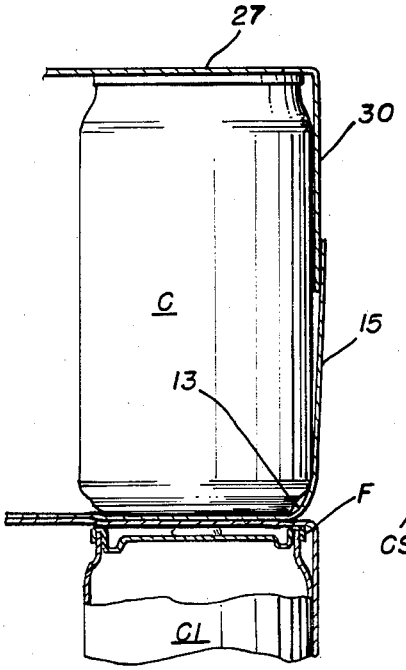
FIG. 5 is a fragmentary cross sectional view taken along the line designated 5—5 in FIG. 1.

This undesired outward bowing of the end closure flaps as shown in FIG. 7 is minimized according to a main feature of this invention as shown in FIG. 5. In FIG. 5, the flange F of the lower can C1 simply engages the bevel strip 13 in the upper carton formed according to this invention without exerting any significant upward force on the end closure flap 15. The result is the substantial elimination of the undesired outward bowing of end closure flaps as shown in FIG. 7.

We claim:

1. A carton for packaging a plurality of articles each having a cylindrical side wall, an inwardly recessed top and a bottom which is secured to the bottom edge of the side wall by an inwardly and downwardly beveled circular connecting structure, said carton comprising top, bottom and side walls foldably adjoined to form an end loading tubular structure, end closure flaps foldably joined to each end edge of said top and side walls, and a bottom end closure flap adjoined to each end edge of said bottom wall by an upwardly and outwardly inclined bevel strip.

2. A carton according to claim 1 wherein each of said bevel strips is approximately equal in width to said circular connecting structure.

3. A carton according to claim 1 wherein each of said bevel strips is foldably adjoined along an inner edge thereof to an end edge of said bottom wall and along an outer edge thereof to the bottom edge of the associated bottom end closure flap.

4. A carton according to claim 1 wherein each of said bevel strips is disposed at an obtuse angle to said bottom wall.

5. A carton according to claim 1 wherein each of said bevel strips is disposed at an obtuse angle to the associated bottom end closure flap.

6. A carton according to claim 1 wherein said end closure flaps which are foldably joined respectively to the ends of said top wall are disposed in flat face contacting overlapping relation with the end closure flaps which are foldably joined respectively to the ends of said side walls and wherein each of said bottom end closure flaps is bonded to the associated end closure flaps which are foldably joined to the ends of said top wall and to the ends of said side walls.

7. A carton according to claim 6 wherein the outer corners of the end flaps which are foldably joined to said top wall are cut away so that an application of adhesive to the inner surface of each of said bottom end flaps forms a bond with the associated end closure flaps which are foldably joined to the end edges of said top wall and to the associated end closure flaps which are foldably joined to the ends of said side walls.

8. A carton according to claim 1 wherein stacking of cartons arranged in tiers one above the other in coincidental relation is such that the bottoms of the cans in an upper tier are disposed within the inwardly recessed tops of the cans in the tier disposed immediately below the cans in the upper tier, so as to prevent outward bowing of said end closure flaps and of said bottom end closure flaps at both ends of the cartons in the upper tier of cartons due to the angular disposition of the bevel strips in the cartons in the upper tier of cartons.

* * * * *